United States Patent [19]

Bolhuis et al.

[11] Patent Number: 4,952,842

[45] Date of Patent: Aug. 28, 1990

[54] DC/AC CONVERTER FOR IGNITING AND SUPPLYING A GAS DISCHARGE LAMP

[75] Inventors: Pieter J. Bolhuis; Johannes M. Van Meurs; Adrianus M. J. De Bijl, all of Eindhoven, Netherlands

[73] Assignee: U.S. Philips Corporation, New York, N.Y.

[21] Appl. No.: 255,072

[22] Filed: Oct. 7, 1988

[30] Foreign Application Priority Data

Oct. 19, 1987 [NL] Netherlands ..... 8702489

[51] Int. Cl.[5] ..... H05B 37/02

[52] U.S. Cl. ..... 315/106; 315/226; 315/240; 315/244; 315/DIG. 7

[58] Field of Search ..... 315/106, 260 R, 226, 315/219, 240, 244, DIG. 4, DIG. 7

[56] References Cited

U.S. PATENT DOCUMENTS

| | | | |
|---|---|---|---|
| 4,339,690 | 7/1982 | Regan et al. | 315/97 |
| 4,532,456 | 7/1985 | Knoll et al. | 315/244 X |
| 4,559,478 | 12/1985 | Fuller et al. | 315/219 X |
| 4,588,924 | 5/1986 | Luursema et al. | 315/106 X |
| 4,642,525 | 2/1987 | Widmayer | 315/219 |
| 4,647,820 | 3/1987 | Chermin et al. | 315/245 |

*Primary Examiner*—Robert J. Pascal

*Attorney, Agent, or Firm*—Bernard Franzblau

[57] ABSTRACT

A DC/AC converter for igniting and supplying a gas discharge lamp (1). The converter has two input terminals (C, D) intended to be connected to a DC voltage source, said input terminals (C, D) being connected together by means of a series arrangement including a load circuit comprising at least an induction coil (10) and a parallel arrangement of the lamp and a capacitor (12), as well as a first semiconductor switching element (13). The load circuit is shunted by a circuit comprising a second semiconductor switching element (14). The semiconductor switching elements (13, 14) are rendered alternately conductive and non-conductive by means of control circuits (13*a*, 14*a*). A second capacitor (11) is arranged in series with the induction coil (10) and the lamp. The second capacitor is shunted by a third switching element (15) which is non-conductive during the pre-heat period of the lamp electrodes (2, 3) and is conductive at least during ignition of the lamp.

12 Claims, 1 Drawing Sheet

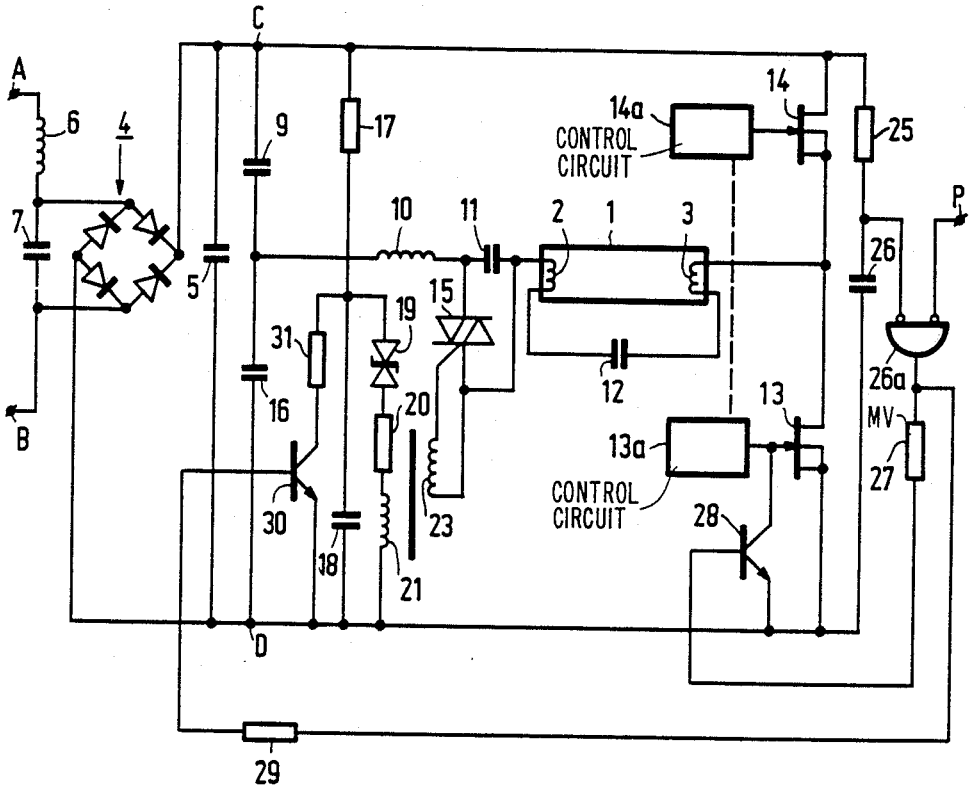
A
B
C
D
P
MV
CONTROL CIRCUIT
CONTROL CIRCUIT

DC/AC CONVERTER FOR IGNITING AND SUPPLYING A GAS DISCHARGE LAMP

BACKGROUND OF THE INVENTION

This invention relates to a DC/AC converter for igniting and supplying a gas discharge lamp. The converter has two input terminals intended to be connected to a DC voltage source and with said input terminals connected together by means of a series arrangement of a load circuit comprising at least an induction coil and a parallel arrangement of the lamp and a capacitor, as well as a first semiconductor switching element. The load circuit is shunted by a circuit comprising a second semiconductor switching element, said semiconductor switching elements being rendered alternately conducting and non-conducting by means of control circuits. A converter of this type is known from the Netherlands Patent Application No. 8400923 (which corresponds to U.S. Pat. No. 4,647,820, issued 3/3/87).

This Patent describes a high-frequency operated half-bridge converter with a discharge lamp incorporated in the load circuit. It has been found that the voltage across the lamp in the known circuit is not low enough during pre-heating of the electrodes. This is detrimental because it creates the risk of the lamp igniting on too cold electrodes, which adversely affects the life-time of the lamp.

SUMMARY OF THE INVENTION

It is an object of the invention to provide a DC/AC converter for operating a discharge lamp which obviates the above-mentioned drawback.

According to the invention, a DC/AC converter of the type described in the opening paragraph is therefore characterized in that a second capacitor is arranged in series with the induction coil and the lamp, which capacitor is shunted by a third switching element which is non-conductive during the period of pre-heating the electrodes and is conductive at least during ignition of the lamp.

As compared with the known circuit, the arrangement of an extra capacitor in the load circuit of the lamp and the induction coil will result in a lower voltage across the lamp during pre-heating of the electrodes at the same electrode current. The arrangement of a larger capacitor in parallel across the lamp for the purpose of achieving this object is avoided. During operation, such a capacitor gives rise to large energy losses in the induction coil, the lamp electrodes and the semiconductor switching elements. After pre-heating, the switching element (consisting of, for example, a triac, a diode bridge with a switching transistor or a thyristor) is rendered conductive so that the said capacitor is short-circuited. Immediately after the short circuit a high voltage is produced across the lamp for ignition purposes.

It is to be noted that a circuit for a system using two "rapid-start" discharge lamps is described in U.S. Pat. No. 4,339,690 in which a capacitor is arranged between the lamps in a circuit of a series arrangement of these lamps. This capacitor is shunted by a switching element and is short-circuited during ignition of the lamps by closing the switching element. Subsequently, the switching element is opened. The capacitor is used as a safeguard to limit the lamp current in lamps which have already ignited. During ignition the voltage is relatively high, so that there is a risk that the lamps ignite on too cold electrodes. In the circuit according to the invention a low lamp voltage yields a relatively large current during preheating of the electrodes.

In a special embodiment of the converter according to the invention is characterized in that the second capacitor (parallel in across the lamp) has substantially the same impedance as the first capacitor.

An advantage of this embodiment is that the induction coil, which is arranged in series with the lamp, has substantially the same value and dimension as compared with the coil in the known circuit.

In another embodiment the third switching element is rendered non-conducting after ignition of the lamp by rendering the converter inoperative for a given period of time (for example, approximately 100 μs). Subsequently, the converter is started again and the element (for example, a triac) remains non-conducting. If the frequency remains equal, the apparent impedances of the coil and the capacitor arranged in series therewith jointly become smaller so that the lamp current increases. The light output of the lamp is then higher.

BRIEF DESCRIPTION OF THE DRAWING

The invention will now be described in greater detail, by way of example, with reference to the accompanying drawing showing diagrammatically an embodiment of the converter according to the invention.

DESCRIPTION OF THE PREFERRED EMBODIMENTS

In the drawing the reference numeral 1 denotes a tubular low-pressure mercury vapour discharge lamp. The lamp has two pre-heatable electrodes 2 and 3.

The terminals C and D are the input terminals of the DC/AC converter. They are intended to be connected to the DC voltage source which is constituted by a diode bridge 4, with a smoothing capacitor 5. The bridge 4 is connected via the coil 6 and the capacitor 7 to an AC voltage source between terminals A and B (220 V, 50 Hz). The coil 6 and the capacitor 7 constitute an input filter.

The terminals C and D are interconnected by means of a series arrangement comprising a capacitor 9, an induction coil 10, a capacitor 11, a parallel arrangement of the lamp 1 with the capacitor 12, as well as a first semiconductor switching element 13. The series arrangement of elements 9, 10, 11 and 1 with 12 is shunted by a circuit comprising a second semiconductor switching element 14. The two semiconductor switching elements 13 and 14 are rendered alternately conducting by means of control circuits **13*a* and 14*a***.

The capacitor 11 arranged in series with the induction coil and the lamp is shunted by a switching element 15 (triac) which is non-conducting during the period when the electrodes are pre-heated and is rendered conducting by means of a control circuit, at least during the subsequent ignition of the lamp. The capacitor 16 connects terminal D to the junction point of capacitor 9 and coil 10. The input terminal C is also connected to terminal D via the series arrangement of a resistor 17 and a capacitor 18. The junction point of 17 and 18 is connected to one end of a primary winding 21 of a transformer 22 via the breakdown element 19 (diac) and the resistor 20 arranged in series therewith. The other end of this winding is connected to terminal D. The secondary winding 23 of the transformer is arranged across the control electrode and an output of triac 15. The elements 17 to 23 constitute the control circuit of the triac 15. The two switching elements 13 and 14 are shunted by a series arrangement of a resistor 25 and a capacitor 26. The junction point of 25 and 26 is connected to an input of a logic 'AND'-gate circuit 26*a*, the output of which is connected to a monostable multivibrator 27 which is connected to the base of switching transistor 28. This transistor is arranged between the gate of transistor 13 and terminal D. The other input of the logic gate circuit is connected to a voltage P which is optionally zero or which has a given fixed value.

Point P is connected, for example, to a photosensitive cell. The output of gate circuit 26*a* is connected via resistor 29 to the base of switching transistor 30. Together with resistor 31, the transistor 30 is arranged in parallel across the capacitor 18.

The converter operates as follows. If the terminals A and B are connected to the mains (220 V, 50 Hz), the capacitor 5 will be charged via the diode bridge 4. This causes the capacitors 9 and 16 to be charged. A starter circuit (not shown in the drawing) will also be activated, so that the switching elements 13 and 14 are rendered alternately conducting by means of the control circuits 13*a* and 14*a*.

After a short time, which is required to pre-heat the electrodes (approximately 1 sec), the breakdown voltage of the element 19 is reached so that a control current is generated in the winding 21 of the transformer 22. The latter element is rendered conducting via the secondary winding 23 and the control electrode of triac 15. The voltage across capacitor 12 increases. The lamp can then ignite. If necessary, the parallel circuit across capacitor 11 is interrupted by means of a separate switch (not shown) after ignition of the lamp.

The control of switching element 13 is short-circuited by means of the elements 25, 26, 26*a*, 27 and 28. The control of switching element 14 is then also interrupted. (The control circuits 13*a* and 14*a* are coupled, for example, via a transformer as described in U.S. Pat. No. 4,647,820; the coupling is denoted by a broken line.) Due to the short circuit the converter is inoperative for a short time (approximately 1 msec) so that triac 15 is turned off and capacitor 11 is again operative. After this short time the converter is started again to prevent the lamp from igniting on too cold electrodes. If triac 15 remains turned off during further lamp operation, the intensity of the current through the lamp is larger. The lamp then has a higher light output. The light output of the lamp can be controlled by means of the elements 26*a*, 27, 29, 30 and 31. If the voltage at terminal P is set to a relatively high value (for example, 5 V), the voltage at the output of the logic gate circuit 26*a* is also high so that the switching element 30 becomes conductive. This switching element ensures that diac 19 remains non-conducting. Triac 15 is then also turned off and capacitor 11 remains operative. However, if a user sets the voltage at P to a low, fixed value (for example, 0 V), the voltage at the output of 26*a* is also relatively low and switching element 30 is non-conducting.

Triac 15 then remains turned on and capacitor 11 is then short-circuited. The light output of the lamp is then lower than in the case where the capacitor 11 is arranged in series with the lamp.

Thus, with the aid of the voltage at terminal P (which is connected, for example, to a photo-electric cell) a dimming effect is realized by means of the elements 26*a*, 27, 29, 30 and 31.

Immediately after ignition of the lamp the short circuit of capacitor 11 can be eliminated by means of the elements 26*a*, 27, 29, 30 and 31. This is effected by giving terminal P a high voltage whereafter element 28 is made conductive (about 1 msec) after several seconds (RC time of 25 and 26). Element 30 is then conductive permanently. The converter is then stopped for a short time (approx. 1 msec). When it is switched on again triac, 15 remains turned off and capacitor 11 is constantly operative.

The converter may also be rendered inoperative if a remote control system is used in which a command pulse is processed in the converter. For example, first the frequency of the converter is increased to 50 kHz (at which the lamp extinguishes). Upon switching on, the converter is switched off for a short time (in a manner as described hereinbefore) whereafter the converter is started again so as to proceed through the entire cycle.

In one embodiment the most important circuit elements had the following values:

capacitor 11: 10 nF
capacitor 12: 10 nF
coil 10: 3 mH
capacitor 9: 470 nF
capacitor 16: 470 nF
capacitor 5: 47 μF.

The discharge lamp was a tubular low-pressure mercury vapour discharge lamp (approximately 1.20 m) having a power of 32 W. The two semiconductor switching elements 13 and 14 were of the MOS-FET type. The frequency was approximately 25 kHz. The triac 15 was of the Philips BT 136 type.

What is claimed is:

1. A DC/AC converter for igniting and supplying a gas discharge lamp comprising: two input terminals for connection to a DC voltage source, said input terminals being connected together by means of a series arrangement of a load circuit comprising at least an induction coil and a parallel arrangement of the lamp and a first capacitor, as well as a first semiconductor switching element, said load circuit being shunted by a circuit comprising a second semiconductor switching element, said semiconductor switching elements being rendered alternately conducting and non-conducting by means of control circuits, a second capacitor connected in series with the induction coil and the lamp, which second capacitor is shunted by a third switching element which is non-conducting during a period of pre-heating of the lamp electrodes and is conducting at least during ignition of the lamp.

2. A DC/AC converter as claimed in claim 1, wherein the second capacitor has substantially the same impedance as the first capacitor.

3. A DC/AC converter as claimed in claim 2, characterized in that the third switching element is rendered non-conducting after ignition of the lamp by rendering the converter inoperative for a given period of time.

4. A DC/AC converter as claimed in claim 1, characterized in that the third switching element is rendered non-conducting after ignition of the lamp by rendering the converter inoperative for a given period of time.

5. A DC/AC converter as claimed in claim 1 further comprising, means for making the converter inoperative for a given period of time after ignition of the lamp thereby to cut-off the third switching elemment.

6. A DC/AC converter for an electric discharge lamp having first and second electrodes comprising:

first and second input terminals for a DC voltage source, means connecting first and second controlled semiconductor switching elements in a first series circuit across said input terminals so as to form a first junction point therebetween, means connecting first and second impedance elements in a second series circuit across said input terminals to form a second junction point therebetween, means connecting an inductor, a first capacitor and a lamp in a series arrangement between said first and second junction points, a second capacitor connected in parallel with the lamp, control means coupled to control electrodes of said first and second semiconductor switching elements to make said switching elements alternately conductive and non-conductive, a third controlled semiconductor switching element connected in shunt with the first capacitor, and means coupled to a control electrode of the third switching element for making the third switching element non-conductive during a pre-heat period for the lamp electrodes and for making it conductive at least during ignition of the lamp.

7. A DC/AC converter as claimed in claim 6 further comprising means for making the converter inoperative for a given period of time after ignition of the lamp thereby to cut-off the third switching element.

8. A DC/AC converter as claimed in claim 6 wherein said means for making the third switching element conductive comprises:

a resistor and a third capacitor connected in a third series circuit across said input terminals to form an RC circuit with a time constant related to the pre-heat period of the lamp electrodes, and a voltage threshold element coupling said RC circuit to the control electrode of the third switching element.

9. A DC/AC converter as claimed din claim 8 wherein said means for making the third switching element non-conductive comprises:

a fourth controlled semiconductor switching element coupled in shunt with said third capacitor, and a gate circuit having a first input coupled to a source of reference voltage, a second input coupled to at least one of said input terminals, and an output coupled to a control electrode of the fourth semiconductor switching element.

10. A DC/AC converter as claimed in claim 9 further comprising means for coupling said output of the gate circuit to the control electrode of one of said first and second semiconductor switching elements.

11. A DC/AC converter as claimed in claim 9 wherein said second input of the gate circuit is coupled to said at least one input terminal via a time delay circuit.

12. A DC/AC converter as claimed in claim 6 wherein said first and second capacitors have approximately the same value of capacitance.

* * * * *